US005373587A

United States Patent [19]

Sexton

[11] Patent Number: 5,373,587

[45] Date of Patent: Dec. 20, 1994

[54] GARMENT SUPPORT DEVICE AND METHOD

[76] Inventor: John M. Sexton, P.O. Box 343, Pleasant Garden, N.C. 27313

[21] Appl. No.: 156,292

[22] Filed: Nov. 23, 1993

Related U.S. Application Data

[63] Continuation of Ser. No. 924,907, Aug. 5, 1992, abandoned.

[51] Int. Cl.[5] ..... A41D 1/06; A41F 3/02

[52] U.S. Cl. ..... 2/237; 2/76; 2/221; 2/312

[58] Field of Search ..... 2/76, 79, 217, 220, 2/221, 227, 230, 239, 300, 312, 311, 310, 313, 314, 315, 316, 317, 318, 319, 320, 321, 322, 323, 324, 325, 326, 327, 328, 338, 44, 92; 450/155; 128/96.1; 602/19

[56] References Cited

U.S. PATENT DOCUMENTS 2,018,981 10/1935 Tietjien ..... 128/96.1

5,212,839 5/1993 Sliman et al. ..... 2/312 X

*Primary Examiner*—Jeanette E. Chapman

[57] ABSTRACT

A releasable garment support device is provided for pants, trousers and other garments whereby the waist of the garment can be readily adjusted to fit a wearer who rapidly increases or decreases his waist size. The device comprises a thin, elongated member which is attached at each end inside the waistband to form a chord along an arc of the waist circumference to reduce the effective size of the waist opening.

8 Claims, 2 Drawing Sheets

GARMENT SUPPORT DEVICE AND METHOD

This is a continuation of application Ser. No. 07/924,907 filed Aug. 5, 1992, now abandoned.

BACKGROUND OF THE INVENTION

1. Field of the Invention

The invention herein pertains to garments and particularly concerns a device and method for reducing the opening of the waist of pants, shorts or other outer garments to allow the garments to be comfortably and stylishly worn by people having a waist size smaller than the waist circumference of the garment.

2. Description of the Prior Art and Objectives of the Invention

In recent years people have become more conscious of their body weight and have increased their dieting and exercise habits in order to maintain a desirable body size and fat percentage. It is not unusual for adults to have waist measurements which vary more or less a few inches in a year. For example, many young adults put on weight during the winter months and then shed the extra pounds in the spring and summer as more rigorous physical activity is carried out. Accordingly, the waist measurement of an adult male may easily vary two to four (2–4) inches during the year without a significant different in the individual's overall appearance. Alterations to pants, dress and sport trousers are oftentimes required if the individual is to maintain a professional appearance with body weight and size fluctuations. Modifications are performed by removing the stitches from the waist, rear and crotch seams and after proper sizing, sewing new seams. Such alterations are costly and can take several days or weeks to complete at great inconvenience to the garment owner. As many suit and trouser fabric blends are suitable for year-round wear, trousers may need altering twice or more a year if the individual's weight significantly increases and decreases several times within the year.

In the past various types of adjusting belts and elastic bands have been employed to address this problem such as set forth in Posson's U.S. Pat. No. 2,663,027. Hofmann's U.S. Pat. No. 2,668,958 teaches adding an adjusting strap to trouser waists allowing the circumference to be modified. A waistband reducer is also set forth in U.S. Pat. No. 4,920,581 of Gray which includes an elastic strap. While these devices have met with some measure of success, they all generally work on the principal of reducing the circumference of the original waistband of the trousers causing unsightly "gathering" of the original waistband by an elastic inner belt or strap. This gathering generally is unattractive and is undesirable for a proper "dressed" appearance.

Therefore, with the known disadvantages and problems associated with prior art devices, it is one objective of the present invention to provide an easily attachable pants support device which decreases the waist opening of a garment for the wearer who has lost weight.

It is another objective of the present invention to provide a pants support device which can be easily adjusted for a particular wearer and which can be quickly removed if a weight increase occurs.

It is still another objective of the present invention to provide a pants support device which can be quickly removed from one pair of pants and attached to another, thus eliminating the need of several such pairs of support devices for several garments.

It is still yet another objective of the present invention to provide a device which will allow a person to wear a particular pair of pants, even with a relatively large weight loss without detracting from the appearance of the pants since the device remains hidden along the inside of the waist and the outer configuration of the pants does not change.

Various other objectives and advantages of the present invention will become more apparent to those skilled in the art as the detailed presentation set forth below is understood.

SUMMARY OF THE INVENTION

The aforesaid and other objectives are realized by providing a planar longitudinal fabric garment support device and method in which the device is releasably attached to the waistband of, for example, a pair of dress trousers. The device is affixed at two points inside the waistband and acts as a chord of an arc on the waistband circumference and effectively reduces the waist opening of the garment. It is usual that two such support devices will be employed along the sides of the pants and may be releasably attached thereto by a variety of means including buttons, snaps, hook and loop fasteners, closeable mechanical grippers or the like at the ends thereof. The device may consists of a thin, flexible textile fabric strap or band which has been woven and may include an elastic section to provide an additional adjustment and comfort for the wearer. Once in place, the device does not "gather" the outer or original garment waist area or band but yet serves as a support against the wearer's body and allows the garment to neatly maintain its original waist circumference during wear while providing security against falling from the wearer.

DESCRIPTION OF THE PREFERRED EMBODIMENT

Figure 1:
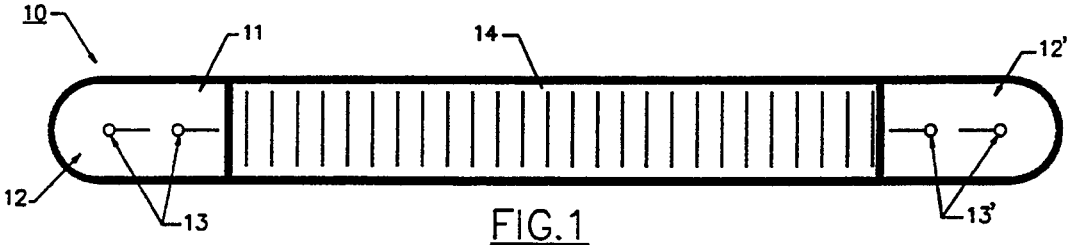
FIG. 1 demonstrates a top plan view of a single garment support device detached from the pants.
Figure 3:
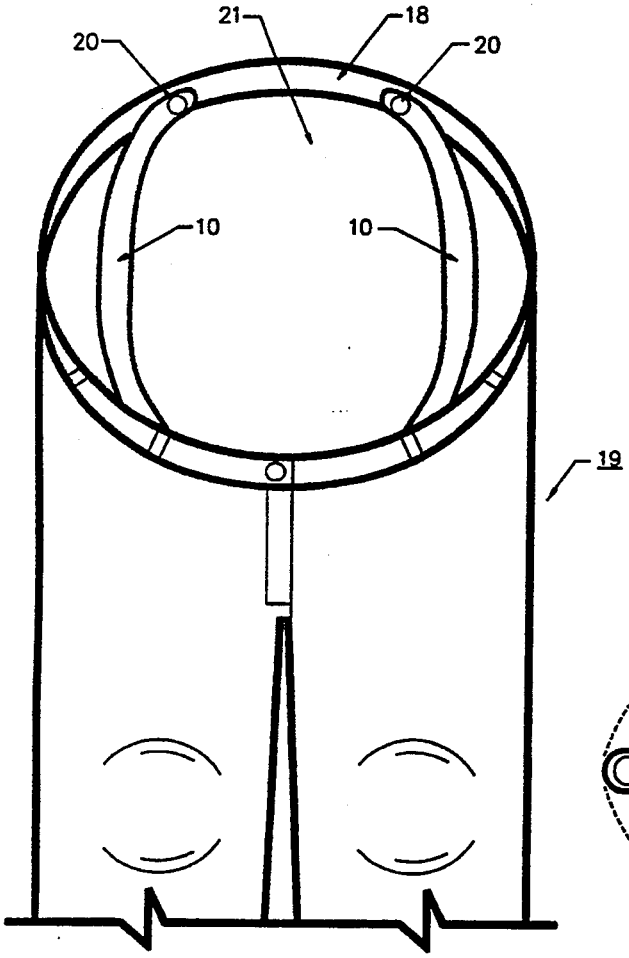
FIG. 3 demonstrates the device as attached in a pair of trousers.
Figure 5:
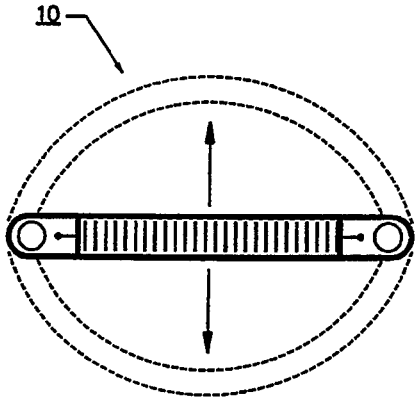
FIG. 5 shows an exaggerated movement of the garment support device as positioned on a waistband.
Figure 7:
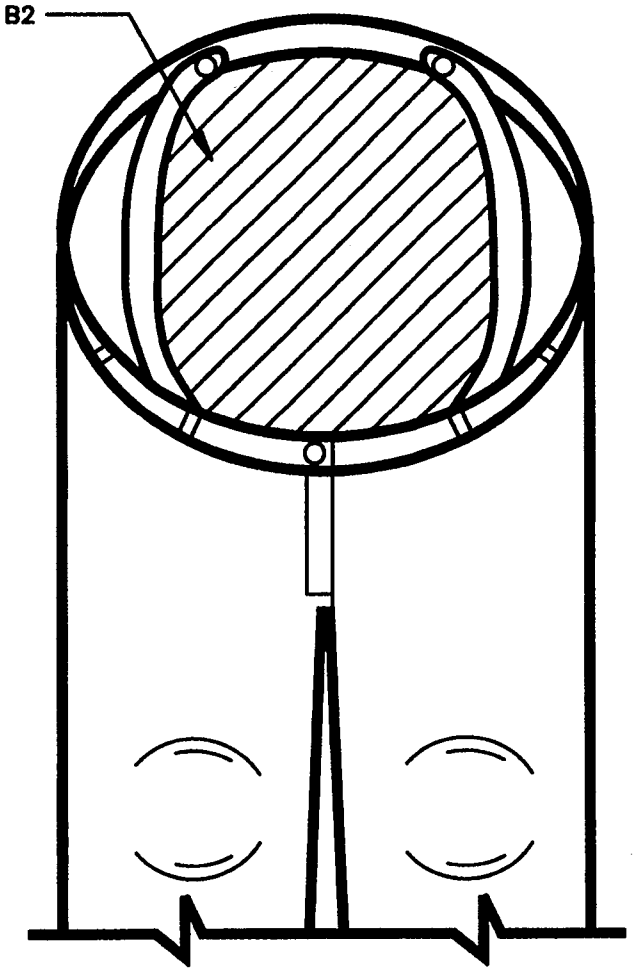
FIG. 7 depicts the pants of FIG. 6 with the invention in place for a small body seen in cross-section.
Figure 6:
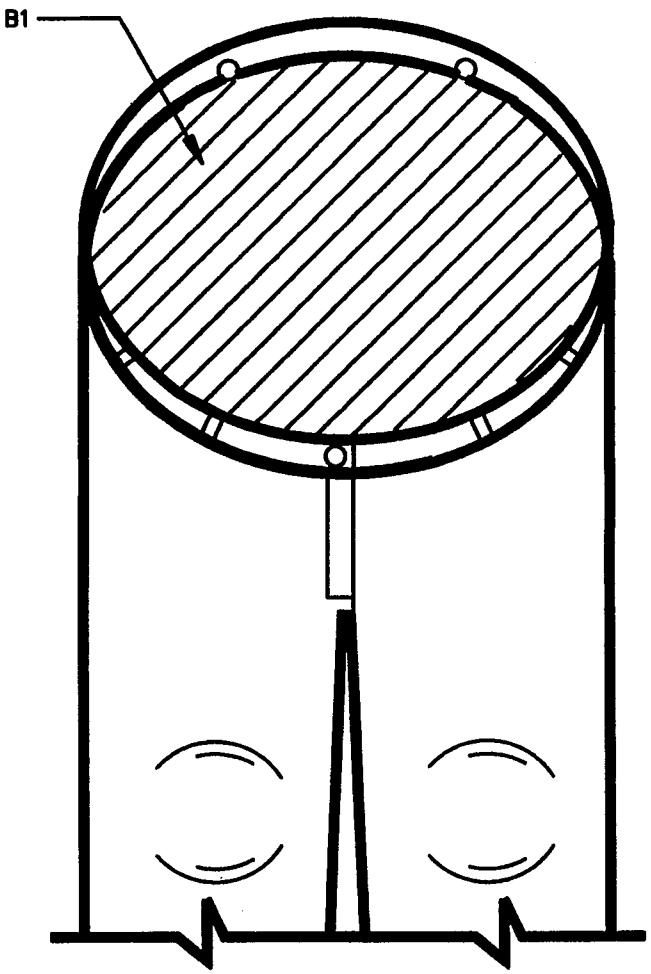
FIG. 6 illustrates a pair of pants with the cross-section of a large body therein.

The preferred form of the invention is shown in FIG. 1 whereby an elongated, flexible band member is formed from a thin, woven textile fabric and includes rounded opposing ends which define a plurality of button receiving apertures therein. The device is woven from yarns such as nylon or cotton and includes a resilient midportion woven with elastic yarns to allow longitudinal stretch to substantially double the length of the midportion if desired. The overall length of the device as shown in FIG. 1 may be for example, twelve inches with a four and one-half inch length resilient midportion and three and one-half inch end sections. This length is suitable for trousers having a 38 inch waist opening circumference to reduce the effective circumference to 32–36 inches when using a pair of garment support devices. The width of the device may be one inch and each end has been rounded for convenience in use. The elastic midportion provides a friction producing outer surface with the elongated member attached at the ends to the waistband to allow it to move or pivot as shown in FIG. 5. In the preferred method the apertures allow adjustment by selection and reception of suspender buttons which are conventionally affixed along the inner circumference of the waistband which defines the waist opening of the trousers as shown in FIG. 3, wherein a pair of devices as described are utilized and act as a pair of chords on the circular waistband.

DETAILED DESCRIPTION OF THE DRAWINGS AND OPERATION OF THE INVENTION

For a more complete understanding of the invention and its method of use, turning now to the drawings, FIG. 1 demonstrates garment support device 10 which comprises a thin, elongated member 11 having end portions 12, 12' which are rounded for convenience in use and for appearance. Various lengths of device 10 can be employed, depending on the garment size and waist size of the user. Ends 12, 12' may be formed from various fabrics such as woven cotton or synthetic fibers and include a plurality of apertures 13 therein. Apertures 13, 13' selectively receive suspender buttons as are normally positioned along the inner waistband of dress trousers. Midportion 14 of garment support 10 as seen in FIG. 1 is formed from an elastic yarn to provide resiliency and stretch, although midportion 14 could be formed of woven cotton, polyester or other yarns as a stretchable midportion is not necessary for the device to operate satisfactorily.

Figure 2:
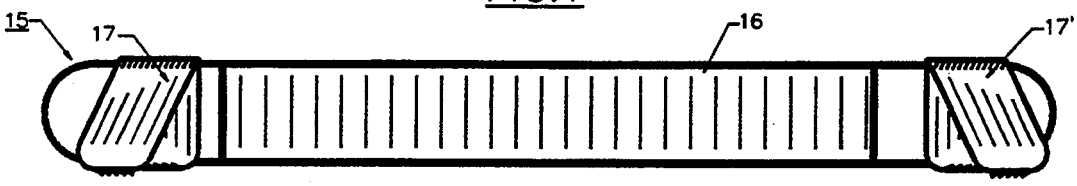
FIG. 2 shows yet another embodiment of the garment support device employing mechanical grippers.

In FIG. 2, garment support device 15 is shown in which elongated member 16 consists of an elongated fabric band without a stretchable midportion having closable mechanical grippers 17, 17' affixed at each end thereof. In the embodiment as shown in FIG. 2, mechanical grippers 17, 17' are placed over waistband 18 and grippers 17, 17' are closed thereon to hold support device 15 in place.

Figure 4:
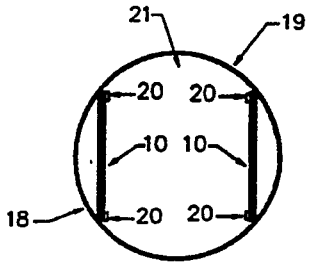
FIG. 4 shows a top schematic view of the waist of the trousers as seen in FIG. 3.

As would be understood, garment 19 as shown in FIG. 3 may consists of a pair of dress trousers, sports pants, shorts or other waistband type garment. The support device as featured herein may also be useful for women's apparel such as skirts but has found a primary use in trousers or the like. As further shown in FIG. 3, a pair of garment support devices 10 are affixed inside along each side of waistband 18. Support devices 10 effectively decrease the circumference of waist opening 21 of trousers 19 to allow a wearer who has lost weight to comfortably use the same pants without the necessity of sewing alterations. In FIGS. 3 and 4 support devices 10 are fastened to waistband 18 by placing suspender buttons 20 through button apertures 13, 13' as shown in FIG. 1. As would be understood, a plurality of openings 13, 13' in elongated member 11 allow for fine adjustment and resilient midportion 11 also provides stretch and adjustability for the particular wearer.

It should be understood that support device 10 does not "gather" the outer waistband or area of trousers 19. Midportion 11 which includes elastic fibers provides resiliency but is not absolutely necessary since a conventional, nonstretchable fabric as provided in the embodiment as featured in FIG. 2 can be utilized instead.

During use, support device 10 as shown in FIG. 5 is free to move or pivot as midportion 11 is not affixed to the waistband. This movement provides greater comfort to the wearer and prevents outer distortion of trouser waistband 18 as understood from the movement depicted in FIG. 4.

As further seen in the embodiments of FIGS. 1 and 2, various fastening means can be used and other types of fasteners may include hook and loop attachments, snaps and of course the garment support device could be sewed into the pants and later removed if the waist of the wearer increases. This utilization might be particularly important for children which grow several inches in a particular year.

In the method of use, support device 10 reduces the effective inside waist opening 21 circumference of the garment by its attachment along the inside of waistband 18 as shown in FIG. 4. Support device 10 acts as a chord to arc 21 of waistband 18 and decreases the effective opening circumference of waistband 18 by the difference in the length of arc 21 as compared to the length of support device (chord) 10. Two such support devices 10 are shown in FIGS. 3 and 4 although only one may be used under certain circumstances.

The illustrations and examples provided herein are for explanatory purposes and are not intended to limit the scope of the appended claims.

I claim:

1. A device for effectively reducing a garment waist opening while allowing an outside waist of the garment to remain constant in combination with a garment having a waist with front, rear and side portions comprising: an elongated flexible member with a midportion and ends, means to directly pivotally fasten only the ends of said elongated member to an inside of the waist of said garment while allowing the midportion to be spaced therefrom, one end of said elongated member attached to said front of said waist and the other end attached to said rear of said waist to position the elongated member inside said waist along one side to allow it to pivot along said side whereby said elongated member will reduce an effective waist dimension as defined by the front and back of a garment and said elongated member as compared with the waist dimension of the garment alone.

2. The combination as claimed in claim 1 wherein said elongated member comprises a thin band.

3. The combination as claimed in claim 2 wherein said thin band is formed of fabric.

4. The combination as claimed in claim 2 wherein said thin band comprises a resilient material.

5. A device for effectively reducing a garment waist opening while allowing an outside waist of the garment to remain constant in combination with a garment having a waist with front, rear and side portions comprising: a pair of elongated flexible members with a midportions and ends, means to directly pivotally fasten only the ends of said elongated members to an inside of the waist of said garment while allowing midportions to be spaced therefrom, one end of said elongated members attached to said front of said waist and the other ends attached to said rear of said waist to position the elongated members inside said waist along each side to allow said elongated members to pivot along each side whereby said elongated members will reduce an effective waist dimension as defined by the front and back of the garment and said elongated members as compared with an waist dimension of the garment alone.

6. The combination as claimed in claim 5 wherein said elongated members comprise thin bands.

7. The combination as claimed in claim 5 wherein said thin bands are formed of fabric.

8. The combination as claimed in claim 5 wherein said thin bands comprise resilient material.

* * * * *